US005165723A

United States Patent [19]

Evans

[11] Patent Number: 5,165,723

[45] Date of Patent: Nov. 24, 1992

[54] BOOK HOLDER

[76] Inventor: Ronnie Evans, 3131 Gertrude, Dearborn, Mich. 48124

[21] Appl. No.: 720,257

[22] Filed: Jun. 24, 1991

[51] Int. Cl.[5] ..... B42D 9/00

[52] U.S. Cl. ..... 281/42; 281/45; 24/336; 24/67.9

[58] Field of Search ..... 281/42, 45, 51, 15.1; 24/336, 67 R, 67.3, 67.9

[56] References Cited

U.S. PATENT DOCUMENTS

| | | | |
|---|---|---|---|
| 400,628 | 4/1889 | Ash | 281/42 X |
| 1,196,715 | 8/1916 | Noll . | |
| 1,710,949 | 4/1929 | Pokora . | |
| 4,382,617 | 5/1983 | Fortier . | |
| 4,474,383 | 10/1984 | Kikis . | |
| 4,512,542 | 4/1985 | Black . | |
| 4,645,236 | 2/1987 | Kemp, Jr. . | |
| 4,932,680 | 6/1990 | Rivera . | |

FOREIGN PATENT DOCUMENTS

| | | | |
|---|---|---|---|
| 6537 | of 1895 | United Kingdom | 281/42 |

*Primary Examiner*—Timothy V. Eley
*Assistant Examiner*—Willmon Fridie, Jr.
*Attorney, Agent, or Firm*—Peter D. Keefe

[57] ABSTRACT

A book holder of a simply connected wire construction having two wire elements, each of which having a base portion. The base portions are mutually separated a relatively small predetermined distance. At either side of the base portion of each wire element, the wire elements conjoin so as to form U-shaped ends. The U-shaped ends are dimensioned so as to provide a V-shaped overhang for trapping the pages of a book between the overhangs and the respective adjacent base portions.

14 Claims, 1 Drawing Sheet

BOOK HOLDER

BACKGROUND OF THE INVENTION

1. Field of the Invention

The present invention relates to book holders for holding open a book so as to facilitate reading of the pages of the book. Still more particularly, the present invention relates to a book holder which is of a simple, light and easy to use construction.

2. Description of the Prior Art

The process of reading a book can become somewhat tedious, in that the reader must constantly hold open the book against the resilient action of its spine. More importantly, those readers who are physically handicapped must struggle all the more with keeping the book open in a configuration that favors page reading.

In the prior art there have been various kinds of book holders, as exemplified by the following U.S. patents. U.S. Pat. No. 1,196,715 to Noll, dated Aug. 29, 1916, discloses a book holder which holds open the pages at the spine of the book via operation of a rear bracket and two spreadable legs. U.S. Pat. No. 1,710,949 to Pokora, dated Apr. 30, 1929, discloses a book holder in which a clip portion is spring loaded with respect to a finger, the finger holding the pages of the book open. U.S. Pat. No. 4,382,617 to Fortier, dated May 10, 1983, discloses a book holder having a central set of prongs which engage the book at the spine, and a set of arms connected thereto for holding the pages open. U.S. Pat. No. 4,474,383 to Kikis, dated Oct. 2, 1984, discloses a book holder having a base with two opposing looped end portions, wherein a book sits atop the base and the pages are held open by capture within the looped end portions. U.S. Pat. No. 4,512,542 to Black, dated Apr. 23, 1985, discloses a book holder in the form of two mutually pivotably connected wires each wire having a looped end portion; legs are hingably connected thereto, as well. U.S. Pat. No. 4,645,236 to Kemp, Jr., dated Feb. 24, 1987, discloses a book holder in the form of a flat member having a slotted flat finger at each end for engaging pages of the book. Finally, U.S. Pat. No. 4,932,680 to Rivera, dated Jun. 12, 1990, discloses a book holder in the form of a wire shaped to include a leg portion that inserts into the spine of the book, and a front transverse portion connected to the leg portion which effects to hold pages of the book in place.

While each of the foregoing patents discloses a book holder which serves to hold pages of a book in an open, readable configuration, each suffers from one or more of the following: excessive complexity, weight, or cost; difficulty to use (too much work to adjust each time a page is turned); and potential damage to the book (wherever a spine engagement is required). Accordingly, what remains needed in the art is a book holder which holes a book open so that the pages may be easily read, is light, inexpensive, and very easily accommodates page turning.

SUMMARY OF THE INVENTION

The present invention is a book holder which holds a book open so that the pages may be easily read, is light, inexpensive, and very easily accommodates page turning.

The book holder according to the present invention is of a simply connected wire construction. Two wire elements are provided, each having a base portion. The base portions are mutually separated a relatively small predetermined distance. At either side of the base portion of each wire element, the wire elements conjoin so as to form U-shaped ends. The U-shaped ends are dimensioned so as to provide an overhang for trapping the pages of a book between the overhang and the respective adjacent base portions.

In operation, the user engages an open book with the book holder so that a portion of opposing sides of the book (that is, the left and right side of the book located at opposite sides of its spine) are captured by the U-shaped ends and the two wire elements. The U-shaped ends are dimensioned so that they do not pose a problem with comfortable reading of the pages. When it is time to turn pages, simple finger movement is all that is necessary to remove the page being turned from the overhang on the right and to trap it under the overhang of the left (and vice versa).

Accordingly, it is an object of the present invention to provide a book holder which is of simple construction, is inexpensive, and light-weight.

It is yet a further object of the present invention to provide a book holder which easily accommodates and facilitates page turning.

These, and additional objects, advantages, features and benefits of the present invention will become apparent from the following specification.

DETAILED DESCRIPTION OF THE PREFERRED EMBODIMENT

Figure 1:
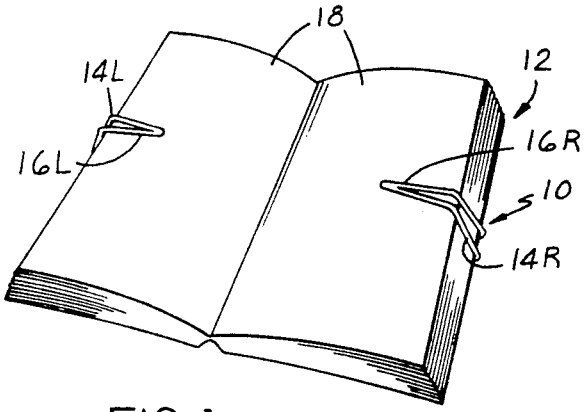
FIG. 1 is a perspective view of the book holder according to the present invention, shown in operation.

Referring now to the Drawing, FIG. 1 shows the book holder 10 according to the present invention in operation in connection with a book 12. As can be discerned from FIG. 1, the book holder 10 includes two generally U-shaped ends 14L and 14R. These U-shaped ends each include a V-shaped overhang 16L and 16R which is dimensioned to engage the pages 18 of the book 12 so as to hold the book in an open, readable configuration.

Figure 2:
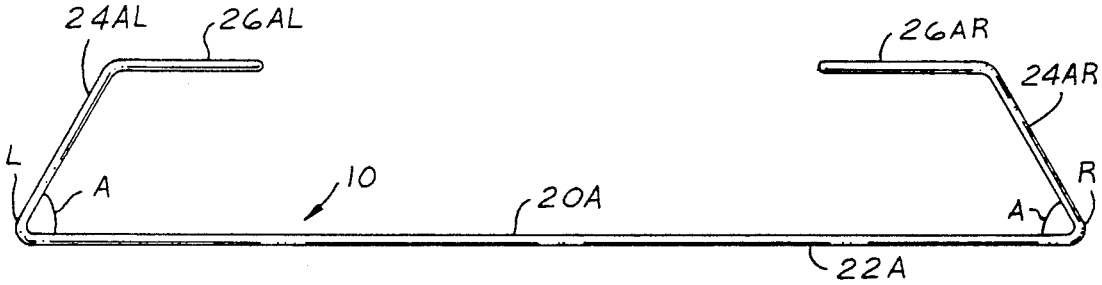
FIG. 2 is a side view of the book holder as shown in FIG. 1.
Figure 3:
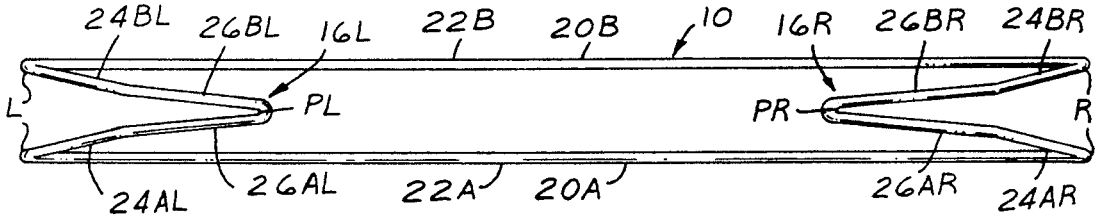
FIG. 3 is a top plan view of the book holder as shown in FIG. 1.
Figure 4:
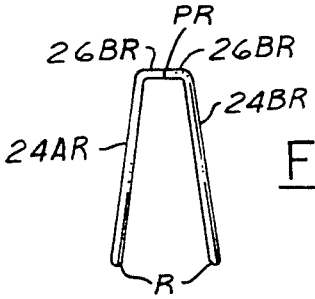
FIG. 4 is an end view of the book holder as shown in FIG. 1.

The structure of the book holder 10 will now be defined, with reference being particularly made to FIGS. 2 through 4.

The book holder 10 is preferred to be constructed of metallic wire, particularly coated metallic wire of a selected color or colors, the coating preferably being of a paint or plastic composition. While stainless steel wire is preferred, for cost reasons other metallic materials may be used. Further, other materials, such as plastic could be used, instead of metallic wire, in which case such materials may be substituted though the use of the term "wire element" is used hereinbelow.

The book holder 10 is preferred to be constructed of two mutually conjoined wire elements 20A and 20B. Each wire element 20A, 20B has a base portion 22A, 22B. The base portions are mutually generally parallel and separated a short distance, on the order of from one-quarter to one inch, but other distances are possible according to design choice. Each of the base portions 22A, 22B terminates at a left location L and right location R. Upright portions 24AL or 24AR, and 24BL or 24BR are integrally connected to the base portions at the left or right location, respectively, as shown particularly in FIG. 3. It is preferred for each of the upright portions to be formed by a bend in respective wire elements 20A and 20B, and that the upright portions be at an angle A of generally 70 to 90 degrees with respect to the base portions. An overhang portion 26AL or 26AR, and 26BL or 26BR are integrally connected, by bending of the wire elements 20A, 20B with respect to the upright portions. As shown in FIG. 3, left overhang portions 26AL and 26AR mutually converge in a V-shape so as to interconnect at a first point PL to thereby form overhang 16L, and right overhang portions 26AL and 26AR mutually converge in a V-shape so as to interconnect at a second point PR to thereby form overhang 16R. Thusly, points PL and PR collectively unit the two wire elements 20A, 20B into a single piece unit. It is preferred for the overhangs to lie in a plane which is oriented generally parallel with respect to the plane in which lies the base portions 22A, 22B. The combination of the overhang portions, the upright portions and that part of the base portions which are generally coextensive with the overhang portions collectively form the U-shaped ends 14L, 14R, there being a U-shaped end at each end wire element.

As an example of a book holder 10, it is preferred to use a number 10 gauge stainless steel wire, having base portions of a length of about 9 inches, having a distance of mutual separation therebetween on the order of one-half inch, having uprights of length of about one and one-half inch, and, finally, having overhang portions on the order of one and one-half inches in length.

It is to be understood that the reason for utilizing two mutually separated base portions 22A, 22B is to render stable connection of the book holder 10 with respect to the book 12 so that operation is facilitated, as described hereinbelow. Further, it is to be understood that the overhang points PR, PL provide an optimum shape which facilitates ease of page turning, as described hereinbelow.

In operation, the user positions an open faces book so that the left edge of the book (on that side of the book left of its spine) is located within the left side U-shaped end, thereby capturing the pages on the left side of the book therein. The user then manipulates the book so that the right edge of the book (on that side of the book right of its spine) is located within the right side U-shaped end, thereby capturing the pages on the right side of the book therein. It is preferred for the book holder 10 to be located about midway between the top and bottom of the book 12, as shown in FIG. 1, but the user may choose to move the book holder up and down the book as desired, and the points PL, PR may be used as last-line-read book marks when reading is temporarily stopped. The right side page may be removed from capture by the overhang at the right side U-shaped end by a simple finger sliding manipulation of the page. The page may then be inserted under the overhang at the left side U-shaped end by finger sliding manipulation of the page thereunder.

Figure 1A:
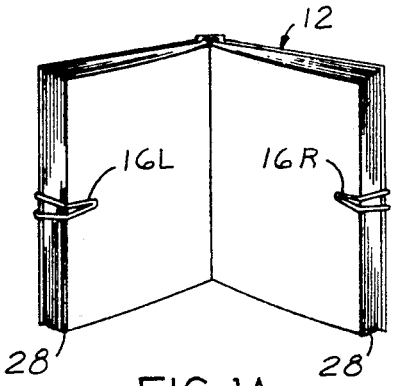
FIG. 1A is a perspective view showing the book holder as shown in FIG. 1, now being used so as to hold a book in an upright attitude.

FIG. 1A shows the book holder 10 holding a book 12 in a free standing attitude with respect to a table top (not shown). This free standing book attitude, which frees the reader from having to hold the book while reading it, is accomplished by simply bending the base portions 22A, 22B at approximately midway between the end locations L, R so that the book is not open flat, thereby allowing the book to stand on its bottom edge 28.

Figure 5:
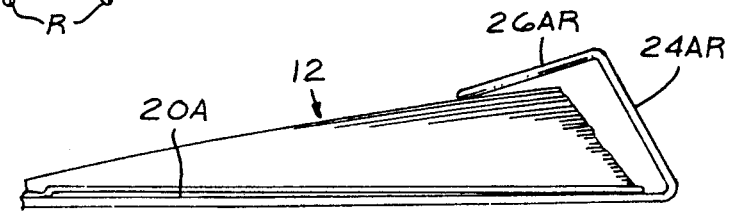
FIG. 5 is a fragmentary side view of the book holder as shown in FIG. 1, now showing the overhang being bent to accommodate the particular thickness of the pages of a book which are trapped thereunder.

FIG. 5 shows how the book holder 10 may be bent by the user to accommodate a particular thickness of the left and/or right sides of the book 12. The user simply bends the overhang portions 26AR, 26BR and/or 26AL, 26BL so that the pages of the book a securely retained by the desired overhang 16L, 16R. This feature can be useful when only a few pages are on one side of the book, or for very thin books. The overhang portions can thereafter by bent back to the desired original shape.

To those skilled in the art to which this invention appertains, the above described preferred embodiment may be subject to change or modification. For instance, while it is described hereinabove that the two wire elements conjoin at the U-shaped ends, this does not necessarily mean that they have been welded or otherwise attached together, since the two wire elements may in fact be integral with one another. In such a case of the two wire elements being an integral single piece, the two wire elements are bent at points PL and PR in order to conform generally with the Drawing, and the two ends of the single piece are mutually connected together at any convenient location of the book holder. Such change or modification can be carried out without departing from the scope of the invention, which is intended to be limited only by the scope of the appended claims.

What is claimed is:

1. A book holder for holding open a book so that the pages thereof may be selectively read by a reader, said book holder comprising:

a first wire element comprising a first base portion, said first base portion having a first length defined by a left end terminating in a first U-shaped end and a right end terminating in a second U-shaped end; and a second wire element comprising a second base portion, said second base portion having said first length defined by a left end terminating in a third U-shaped end and a right end terminating in a fourth U-shaped end, said second base portion being spaced from said first base portion, said second base portion being oriented substantially parallel with respect to said first base portion;

wherein said first U-shaped end is connected with said third U-shaped end so as to form a left end overhang and wherein said second U-shaped end is connected with said fourth U-shaped end so as to form a right end overhang; and wherein a left end portion of the book is placed between said left end overhang and said first and second base portions, and further wherein a right end portion of the book is placed between said right end overhang and said first and second base portions to thereby selectively hold open the book.

2. The book holder of claim 1, wherein said left end overhang and said right end overhang are each formed of a V-shaped terminating in a point, each point being oriented so as to mutually face toward one another.

3. The book holder of claim 2, wherein said first wire element is spaced a distance from said second wire element that is larger than one-quarter inch.

4. The book holder of claim 3, wherein said first and second wire elements are constructed of metallic wire.

5. The book holder of claim 4, wherein said first and second wire elements are constructed of a single piece of metallic wire.

6. A book holder for holding open a book so that the pages thereof may be selectively read by a reader, said book holder comprising:

a first wire element comprising:

a first base portion, said first base portion having a first length defined by a left end location and a right end location thereof;

a first upright portion having a second length defined by a first end and a second end thereof, said first end of said first upright portion being connected with said right end location of said first base portion, said first upright portion being oriented relative to said first base portion at a first predetermined angle with respect thereto;

a first overhang portion having a third length defined by a first end and a second end thereof, said first end of said first overhang portion being connected with said second end of said first upright portion, said first overhang portion being oriented at a predetermined orientation with respect to said first upright portion;

a second upright portion having said second length defined by a first end and a second end thereof, said first end of said second upright portion being connected with said left end location of said first base portion, said second upright portion being oriented relative to said first base portion at a second predetermined angle with respect thereto; and a second overhang portion having said third length defined by a first end and a second end thereof, said first end of said second overhang portion being connected with said second end of said second upright portion, said second overhang portion being oriented at a predetermined orientation with respect to said second upright portion; and a second wire element comprising:

a second base portion, said second base portion having said first length defined by a left end location and a right end location thereof, said second base portion being spaced from said first base portion, said second base portion being oriented substantially parallel with respect to said first base portion;

a third upright portion having said second length defined by a first end and a second end thereof, said first end of said third upright portion being connected with said right end location of said second base portion, said third upright portion being oriented relative to said second base portion at said first predetermined angle with respect thereto;

a third overhang portion having said third length defined by a first end and a second end thereof, said first end of said third overhang portion being connected with said second end of said third upright portion, said third overhang portion being oriented at a predetermined orientation with respect to said third upright portion;

a fourth upright portion having said second length defined by a first end and a second end thereof, said first end of said fourth upright portion being connected with said left end location of said second base portion, said fourth upright portion being oriented relative to said second base portion at said second predetermined angle with respect thereto; and a fourth overhang portion having said third length defined by a first end and a second end thereof, said first end of said fourth overhang portion being connected with said second end of said fourth upright portion, said fourth overhang portion being oriented at a predetermined orientation with respect to said fourth upright portion;

wherein said second end of said first overhang portion is connected with said second end of said third overhang portion and wherein said second end of said second overhang portion is connected with said second end of said fourth overhang portion; and wherein a right end portion of the book is placed between said first and third overhang portions and said first and second base portions, and further wherein a left end portion of the book is placed between said second and fourth overhang portions and said first and second base portions to thereby selectively hold open the book.

7. The book holder of claim 6, wherein the connection of said second end of said first overhang portion with respect to said second end of said third overhang portion forms a first overhang having a V-shape terminating in a first point and wherein the connection of the second end of said second overhang portion with respect to said second end of said fourth overhang portion forms a second overhang having a V-shape terminating in a second point, wherein further said first and second points are oriented so as to mutually face toward each other.

8. The book holder of claim 7, wherein said first wire element is spaced a distance from said second wire element that is larger than one-quarter inch.

9. The book holder of claim 8, wherein said first overhang portion and said first upright portion collectively mutually converge with respect to said third overhang portion and said third upright portion from between said first point and each of said first and second base portions; wherein further said second overhang portion and said second upright portion collectively mutually converge with respect to said fourth overhang portion and said fourth upright portion from between said second point and each of said first and second base portions.

10. The book holder of claim 9, wherein said first and second predetermined angles are substantially between 70 and 90 degrees.

11. The book holder of claim 10, wherein said predetermined orientation of each of said first, second, third and fourth overhang portions is such that each of said first, second, third and fourth overhang portions lie in a plane that is substantially parallel with a plane in which each of said first and second base portions lie.

12. The book holder of claim 11, wherein said first and second wire elements are constructed of metallic wire.

13. The book holder of claim 12, wherein said first and second wire elements are constructed of a single piece of metallic wire.

14. The book holder of claim 12, wherein said metallic wire is bendable so as to provide a reader selectable shape.

* * * * *